US006997538B1

(12) United States Patent
Kawamura et al.

(10) Patent No.: US 6,997,538 B1
(45) Date of Patent: Feb. 14, 2006

(54) INKJET PRINTING WITH AIR CURRENT DISRUPTION

(75) Inventors: Naoto Kawamura, Corvallis, OR (US); John Paul Harmon, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/571,959

(22) Filed: May 15, 2000

(51) Int. Cl.
*B41J 2/015* (2006.01)

(52) U.S. Cl. ..... 347/21; 347/34; 347/28

(58) Field of Classification Search ..... 347/21, 347/34, 37, 28, 36, 35, 30; 434/37
See application file for complete search history.

(56) References Cited

U.S. PATENT DOCUMENTS

| | | | | |
|---|---|---|---|---|
| 3,983,801 A | | 10/1976 | Watanabe et al. | 101/1 |
| 4,077,040 A | | 2/1978 | Hendriks | 346/75 |
| 4,369,450 A | | 1/1983 | Iwagami et al. | 346/75 |
| 4,411,706 A | * | 10/1983 | Wallace et al. | 134/37 |
| 4,520,366 A | | 5/1985 | Cragin, Jr. | |
| 4,591,869 A | | 5/1986 | Katerberg et al. | |
| 4,734,717 A | * | 3/1988 | Rayfield | 347/40 |
| 5,528,271 A | * | 6/1996 | Ebisawa | 347/34 |
| 5,625,398 A | | 4/1997 | Milkovits et al. | 347/104 |
| 5,771,050 A | * | 6/1998 | Gielen | 347/19 |
| 5,774,141 A | | 6/1998 | Cooper et al. | 347/34 |
| 5,877,788 A | * | 3/1999 | Haan et al. | 347/28 |
| 6,203,152 B1 | | 3/2001 | Boleda et al. | |
| 6,220,693 B1 | | 4/2001 | Bode et al. | 347/34 |
| 6,318,854 B1 | * | 11/2001 | Rasmussen et al. | 347/104 |
| 6,340,225 B1 | | 1/2002 | Szlucha | |

FOREIGN PATENT DOCUMENTS

| | | | | |
|---|---|---|---|---|
| EP | 0916509 A2 | | 5/1999 | |
| JP | 58-104758 | | 6/1983 | |
| JP | 02-063844 | * | 8/1988 | 347/16 |
| JP | 11-198413 | | 7/1999 | |

OTHER PUBLICATIONS

PCT International Search Report, PCT/US01/15472, mailed Nov. 8, 2001.

* cited by examiner

*Primary Examiner*—Stephen Meier
*Assistant Examiner*—Ly T. Tran

(57) ABSTRACT

An inkjet printer includes a printhead having a plurality of ink orifices formed therein. During printing, ink drops are ejected through the ink orifices into a print zone between the printhead and a print medium. An air current disruption system directs an air stream through the print zone as the ink drops are ejected so as to disrupt air currents acting on the ink drops during printing and prevent print defects caused by the air currents. The air stream, however, does not disrupt an intended trajectory of the ink drops during printing.

26 Claims, 7 Drawing Sheets

INKJET PRINTING WITH AIR CURRENT DISRUPTION

THE FIELD OF THE INVENTION

The present invention relates generally to printing with inkjet printers, and more particularly to an inkjet printer having an air current disruption system which disrupts air currents acting on ink drops ejected during printing, but does not disrupt an intended trajectory of the ink drops during printing.

BACKGROUND OF THE INVENTION

As illustrated in FIG. 1, a portion of a conventional inkjet printer 90 includes a printer carriage 92 and a print cartridge 94 installed in the printer carriage. The print cartridge includes a printhead which ejects or fires ink drops 96 through a plurality of orifices or nozzles 95 and toward a print medium 98, such as a sheet of paper, so as to print a dot of ink on the print medium. Typically, the orifices are arranged in one or more columns or arrays such that properly sequenced ejection of ink from the orifices causes characters or other images to be printed upon the print medium as the print cartridge and the print medium are moved relative to each other.

Image quality and performance of inkjet printing is rapidly approaching that of silver halide photographs and offset printing. The greatest improvement in image quality has been achieved by increasing image resolution which is a measure of the number of dots printed per height of an image, for example, dots-per-inch. Image resolution has been increased by reducing orifice spacing of the printhead and reducing a volume of the ink drops with an understanding that the volume of an ink drop corresponds to a size of the dot formed on the print medium. By reducing the orifice spacing of the printhead and the size of the ink drops, an image becomes sharper, less grainy, and more detailed.

As orifice spacing and drop volume decrease to increase image resolution, however, it becomes necessary to operate the printhead at higher firing frequencies and faster printing speeds to achieve the same throughput. Unfortunately, smaller, more closely spaced ink drops ejected at higher firing frequencies are more greatly influenced by surrounding air than larger, more widely spaced ink drops ejected at lower firing frequencies. Analysis has shown that the rate of kinetic energy transfer between an ink drop and the surrounding air is proportional to the surface area of the ink drop. The kinetic energy transfer rate of many small drops, therefore, is greater than that of fewer large drops. This kinetic energy transfer phenomena generates air currents which develop into air vortices formed between nozzle columns of the printhead. Examples of such air currents and formed air vortices are indicated at 99 in FIG. 1.

The air currents and air vortices, however, misdirect the ink drops as they are ejected toward the print medium and through a print zone. Unfortunately, misdirection of the ink drops yields images which have undesirable print defects or artifacts, including banding and/or "worms." Banding is more prominent in medium density area fills, such as graphics and images, and is characterized by random light and dark bands across an image. Banding is typically caused by misdirection of the ink drops in a paper axis (i.e., a direction perpendicular to a scanning axis). The dark bands result when misdirected ink drops land on ink drops ejected from adjacent nozzles of the printhead and the light bands represent uncovered areas or white space resulting from the same misdirected ink drops. Banding is readily detected at normal viewing distances and is typically very objectionable to a viewer.

Worms are also more prominent in medium density graphics and are characterized by a mottled appearance of an image. Worms are typically caused by a localized misdirection of the ink drops. A predominate cause of worms in low drop volume printheads is misdirection of the ink drops due to air currents generated by air entrained by the ink drops as the ink drops are ejected through the print zone. As such, these air currents disrupt and misdirect trajectories of the ink drops yielding areas of non-uniform area fill, hue shifts, and poor image resolution.

Attempts to mask or hide these print defects have utilized multi-pass print modes, reduced printing speeds, and/or reduced spacing between the print cartridge and the print medium (i.e., pen-to-paper spacing). These attempts, however, are leading in a direction contrary to the desired direction of inkjet printer advancement, such as single-pass print modes, faster printing speeds for higher throughput, increased pen-to-paper spacing for accommodating a greater range of print medium thickness, and higher resolution, lower drop volume printheads.

Accordingly, a need exists for an inkjet printer which substantially eliminates objectionable print defects, such as banding and/or worms, caused by air currents generated by printing, without compromising image resolution, printing speed, and/or print medium flexibility.

SUMMARY OF THE INVENTION

One aspect of the present invention provides an inkjet printer for printing on a print medium. The inkjet printer includes a printhead having a plurality of ink orifices formed therein through which ink drops are ejected into a print zone between the printhead and the print medium during printing. An air current disruption system directs a stream of gas through the print zone as the ink drops are ejected, so as to disrupt air currents acting on the ink drops during printing and prevent print defects caused by the air currents.

In one embodiment, the ink drops are ejected into the print zone between the printhead and the print medium with an intended ink drop trajectory. In one embodiment, the stream of gas disrupts the air currents acting on the ink drops during printing, but does not disrupt the intended ink drop trajectory during printing. In one embodiment, the air current disruption system directs the stream of gas through the intended ink drop trajectory. In one embodiment, the air current disruption system directs the stream of gas substantially perpendicular to the intended ink drop trajectory. In one embodiment, the air current disruption system directs the stream of gas substantially parallel to the intended ink drop trajectory. In one embodiment, the intended ink drop trajectory is substantially perpendicular to a print region of the print medium, and the air current disruption system directs the stream of gas substantially parallel to the print region.

In one embodiment, the ink orifices are formed in a front face of the printhead, and the air current disruption system directs the stream of gas substantially parallel to the front face of the printhead. In one embodiment, the air current disruption system directs the stream of gas in a direction opposite a printing direction. In one embodiment, the air current disruption system directs the stream of gas in a printing direction.

In one embodiment, the air current disruption system includes an flow channel. In one embodiment, the flow channel has an outlet flow path oriented substantially parallel to a print region of the print medium. In one embodiment, the flow channel has an outlet flow path oriented at an angle to a print region of the print medium, with the outlet flow path terminating at least at a front face of the printhead. In one embodiment, the flow channel has at least one outlet flow path offset from a column of the plurality of ink orifices.

In one embodiment, the stream of gas is an air stream. In one embodiment, the air current disruption system includes an airflow source which creates pressurized air within the printer to generate the air stream. In one embodiment, the air current disruption system includes an airflow source which creates a vacuum within the printer to generate the air stream. In one embodiment, the printhead is installed in a printer carriage and movement of the printer carriage within the printer generates the air stream.

In one embodiment, the air currents acting on the ink drops during printing form air vortices and the stream of gas disrupts the air vortices.

In one embodiment, a speed of the stream of gas through the print zone is in a range of approximately 0.5 meters/second to approximately 2.0 meters/second. In one embodiment, a speed of the stream of gas through the print zone is in a range of approximately 1.0 meters/second to approximately 1.5 meters/second.

Another aspect of the present invention provides a method of printing on a print medium with an inkjet printer including a printhead having a plurality of ink orifices formed therein. The method includes the steps of ejecting ink drops through the ink orifices into a print zone between the printhead and the print medium during printing, and directing a stream of gas through the print zone while the ink drops are ejected so as to disrupt air currents acting on the ink drops during printing and prevent print defects caused by the air currents.

The present invention provides a system which disrupts air currents acting on ink drops ejected during printing, but does not disrupt an intended trajectory of the ink drops during printing. As such, undesirable print defects, such as banding and/or "worms," caused by air currents generated by printing operations, are avoided without compromising image resolution, printing speed, and/or accommodation of various thickness of print medium.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
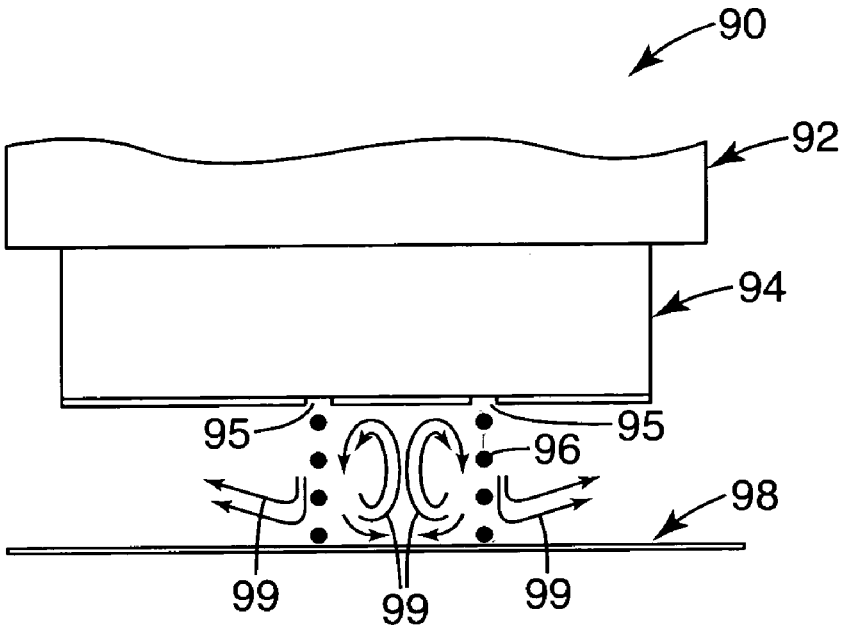
Fig. 1 PRIOR ART
FIG. 1 is a side schematic view of a portion of a prior art inkjet printer.
Figure 2A:
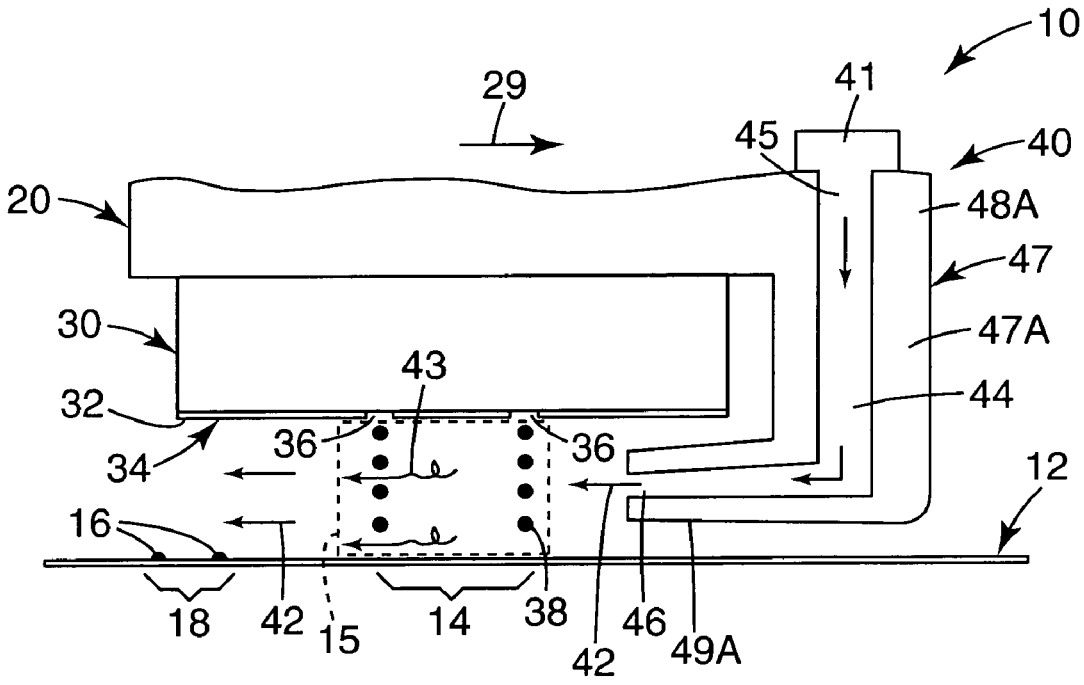
FIG. 2A is a side schematic view of one embodiment of a portion of an inkjet printer including one embodiment of an air current disruption system according to the present invention.
Figure 2B:
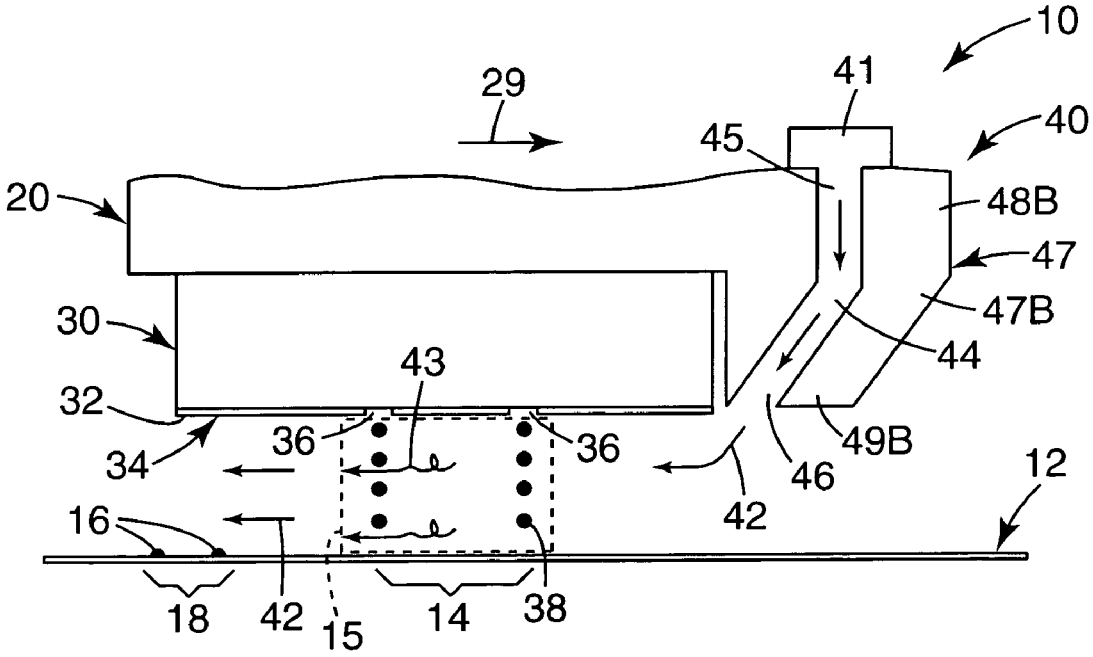
FIG. 2B is a side schematic view of the inkjet printer of FIG. 2A including an alternate embodiment of the air current disruption system according to the present invention.
Figure 2C:
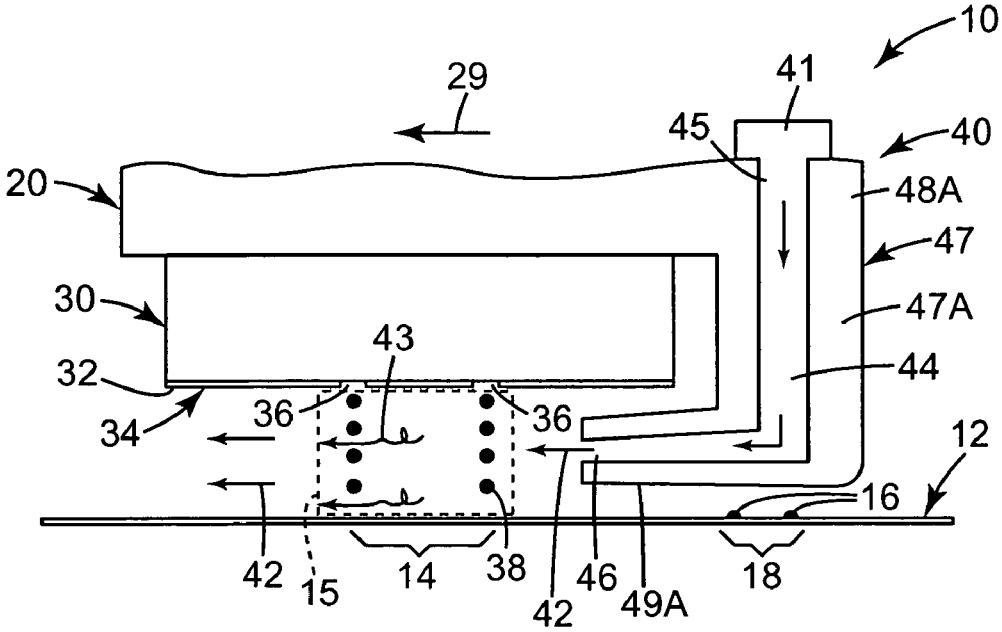
FIG. 2C is a side schematic view of the inkjet printer of FIG. 2A including an alternate embodiment of the air current disruption system according to the present invention.

FIGS. 2A, 2B, and 2C illustrate one embodiment of a portion of an inkjet printer 10 for printing on a print medium 12. Inkjet printer 10 includes a printer carriage 20, a print cartridge 30, and an air current disruption system 40. Print medium 12 includes a print region 14 within which print 16 in the form of characters and graphics is created as relative movement between print cartridge 30 and print medium 12 occurs during printing. Print medium 12 is any type of suitable material, such as paper, cardstock, transparencies, Mylar, and the like. In one embodiment, during printing, print medium 12 is held stationary as printer carriage 20 moves in a printing direction, as indicated by arrow 29, to traverse print medium 12. Upon completing a row of print 16, print medium 12 is advanced in a direction substantially perpendicular to the printing direction indicated by arrow 29 (i.e., in and out of the plane of the paper).

Printer carriage 20 is slidably supported within a chassis (not shown) of inkjet printer 10 for travel back and forth across print medium 12, and print cartridge 30 is installed in printer carriage 20 for movement with printer carriage 20 during printing. Print cartridge 30 includes a printhead 34 having a front face 32 in which a plurality of ink orifices or nozzles 36 are formed in a manner well known to those skilled in the art. Example embodiments of printhead 34 include a thermal printhead, a piezoelectric printhead, flex-tensional printhead, or any other type of inkjet ejection device known in the art. If printhead 34 is, for example, a thermal printhead, printhead 34 typically includes a substrate layer (not shown) having a plurality of resistors (not shown) which are operatively associated with ink orifices 36. Upon energization of the resistors, in response to command signals delivered by a controller (not shown) to printer carriage 20, drops of ink 38 are ejected through ink orifices 36 toward print medium 12.

During printing, ink drops 38 are ejected from printhead 34 toward print region 14 of print medium 12 to create print 16. As printer carriage 20 moves in the printing direction indicated by arrow 29, print 16 creates an already-imprinted region 18 on print medium 12. Ink drops 38 are ejected through ink orifices 36 and from printhead 34 into a print zone 15 with an intended ink drop trajectory. Print zone 15 is defined as being between printhead 34 and print medium 12, and encompasses ink drops 38. As such, print zone 15, as well as print region 14 of print medium 12, move with printer carriage 20 during printing. The intended ink drop trajectory is defined by a plurality of ink drops 38 ejected toward print medium 12 to form a curtain of ink drops 38 extending between printhead 34 and print medium 12. In one embodiment, the intended ink drop trajectory is substantially perpendicular to print region 14 of print medium 12.

Air current disruption system 40 directs a stream of gas, for example, an air stream 42, through print zone 15 as ink drops 38 are ejected from printhead 34 during printing. As such, air current disruption system 40 disrupts air currents, as illustrated at 43, acting on ink drops 38 during printing so as to prevent print defects caused by the air currents. Air current disruption system 40, however, does not disrupt the intended ink drop trajectory of ink drops 38 during printing. While the following description only refers to using air, it is understood that use of other gases, or combinations of gases, is within the scope of the present invention.

In one embodiment, as illustrated, for example, in FIGS. 2A, 2B, and 2C, air stream 42 is directed substantially perpendicular to the intended ink drop trajectory and substantially parallel to print region 14 of print medium 12 toward which ink drops 38 are ejected. As described above, the intended ink drop trajectory is defined by a plurality of ink drops 38 ejected toward print medium 12 to form a curtain of ink drops 38 extending between printhead 34 and print medium 12. Thus, with air stream 42 being directed substantially perpendicular to the intended ink drop trajectory, air stream 42 is directed substantially perpendicular to a curtain of ink drops 38 extending between printhead 34 and print medium 12. In addition, as the curtain of ink drops 38 is formed by a column of ink orifices 36, air stream 42 is directed substantially perpendicular to a column of ink orifices 36.

In one embodiment, air current disruption system 40 includes an airflow channel 44 which directs air stream 42 through print zone 15. Airflow channel 44 includes an inlet flow path 45 and an outlet flow path 46. Inlet flow path 45 communicates with an airflow source 41 which creates a pressurized source of air which, in turn, generates and forces air stream 42 through airflow channel 44.

In one embodiment, airflow source 41 includes a direct source which communicates with inlet flow path 45 and forces air stream 42 through airflow channel 44. An example of airflow source 41 is a fan positioned within inkjet printer 10. In another embodiment, airflow source 41 includes an indirect source which communicates with inlet flow path 45 and forces air stream 42 through airflow channel 44. Thus, another example of airflow source 41 is inkjet printer 10 itself. More specifically, air stream 42 is generated by movement of printer carriage 20 within inkjet printer 10. Printer carriage 20, for example, is slidably fitted within an elongated cavity (not shown) of the chassis of inkjet printer 10 such that motion of printer carriage 20 generates a high-pressure area within a portion of the cavity on a side of printer carriage 20 preceding print formation. As such, the portion of the cavity on the side of printer carriage 20 preceding print formation is communicated with airflow channel 44 to create air stream 42. While airflow source 41 is illustrated as being positioned adjacent inlet flow path 45, it is within the scope of the present invention for airflow source 41 to be positioned remotely from and communicated with inlet flow path 45.

In one embodiment, as illustrated in FIGS. 2A, 2B, and 2C, airflow channel 44 is formed by an airflow duct 47 provided at a side of printer carriage 20 for travel with printer carriage 20 during printing. While airflow duct 47 is illustrated as being formed integrally with printer carriage 20, it is within the scope of the present invention for airflow duct 47 to be formed separately from printer carriage 20. As such, it is also within the scope of the present invention for airflow duct 47 to move with printer carriage 20 or be held stationary relative to printer carriage 20.

FIGS. 2A and 2C illustrate one embodiment of airflow duct 47. Airflow duct 47A includes an inlet portion 48A forming inlet flow path 45 of airflow channel 44 and an outlet portion 49A forming outlet flow path 46 of airflow channel 44. Outlet portion 49A is oriented substantially parallel to print region 14 of print medium 12 and substantially parallel to front face 32 of printhead 34. During printing, outlet portion 49A is interposed between print cartridge 30 and print medium 12 such that air stream 42 is directed out outlet flow path 46 of airflow channel 44 and through print zone 15 substantially parallel to print region 14 and front face 32 of printhead 34.

FIG. 2B illustrates another embodiment of airflow duct 47. Airflow duct 47B includes an inlet portion 48B forming inlet flow path 45 of airflow channel 44 and an outlet portion 49B forming outlet flow path 46 of airflow channel 44. Outlet portion 49B is oriented at an angle to print region 14 of print medium 12 and front face 32 of printhead 34. Outlet portion 49B, however, does not project beyond front 32 face of print cartridge 30, so as to permit narrow pen-to-paper spacing. During printing, air stream 42 is directed at an angle toward print medium 12 such that air stream 42 is deflected by print medium 12 and directed through print zone 15 substantially parallel to print region 14 and front face 32 of printhead 34.

Figure 2D:
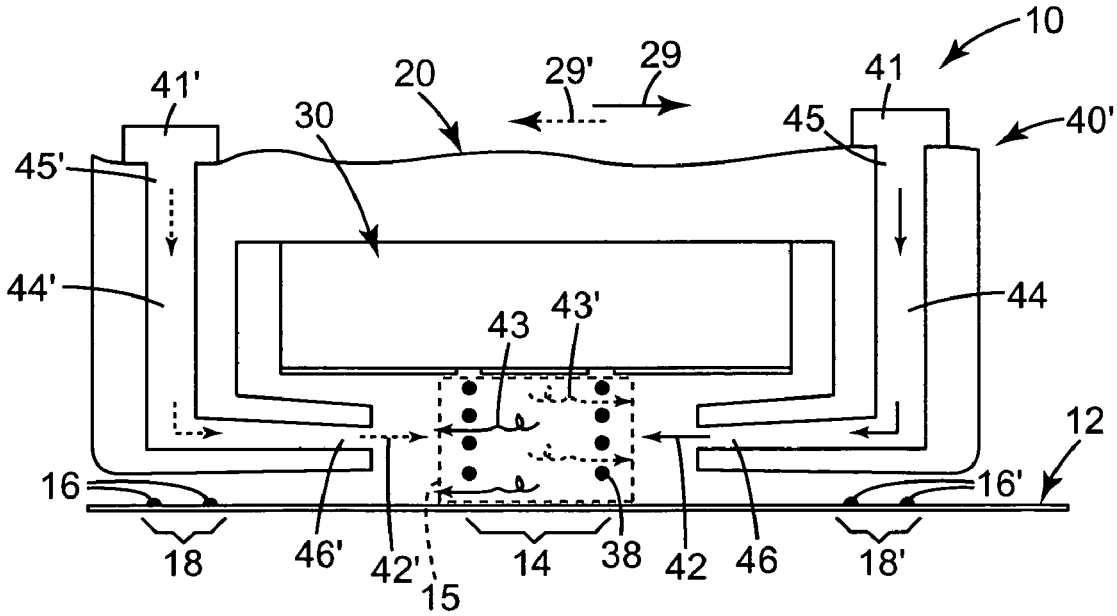
FIG. 2D is a side schematic view of another embodiment of the inkjet printer of FIG. 2A including another embodiment of an air current disruption system according to the present invention.

FIG. 2D illustrates another embodiment of inkjet printer 10 including printer carriage 20, print cartridge 30, and an air current disruption system 40'. During printing, print medium 12 is held stationary as printer carriage 20 moves in the printing direction indicated by arrow 29 to traverse print medium 12, and create print 16 and already-imprinted region 18. Upon completing a row of print 16, print medium 12 is advanced in the direction substantially perpendicular to the printing direction indicated by arrow 29 (i.e., in and out of the plane of the paper). Thereafter, print medium 12 is held stationary as printer carriage 20 moves in a printing direction, as indicated by arrow 29', opposite the printing direction indicated by arrow 29, to traverse print medium 12 and create print 16' and already-imprinted region 18'.

Air current disruption system 40' directs air stream 42 through print zone 15 as ink drops 38 are ejected from printhead 34 during printing when printer carriage 20 moves in the printing direction indicated by arrow 29. Air current disruption system 40' also directs an air stream 42' through print zone 15 as ink drops 38 are ejected from printhead 34 during printing when printer carriage 20 moves in the printing direction indicated by arrow 29'. As such, air current disruption system 40' disrupts air currents, as illustrated at 43 and 43', acting on ink drops 38 during printing when printer carriage 20 moves in the printing directions indicated by arrows 29 and 29', respectively, to prevent print defects caused by the air currents. Air current disruption system 40', however, does not disrupt the intended ink drop trajectory of ink drops 38 during printing.

In one embodiment, air current disruption system 40' includes airflow channel 44 which directs air stream 42 through print zone 15 when printer carriage 20 moves in the printing direction indicated by arrow 29 and an airflow channel 44' which directs air stream 42' through print zone 15 when printer carriage 20 moves in the printing direction indicated by arrow 29'. Accordingly, airflow channel 44 includes inlet flow path 45 and outlet flow path 46, and airflow channel 44' includes an inlet flow path 45' and an outlet flow path 46', wherein inlet flow path 45 communicates with airflow source 41 and inlet flow path 45' communicates with an airflow source 41' similar to airflow source 41. While airflow source 41' is illustrated as being separate from airflow source 41, it is within the scope of the present invention for airflow source 41' and airflow source 41 to be a single airflow source.

Figure 3A:
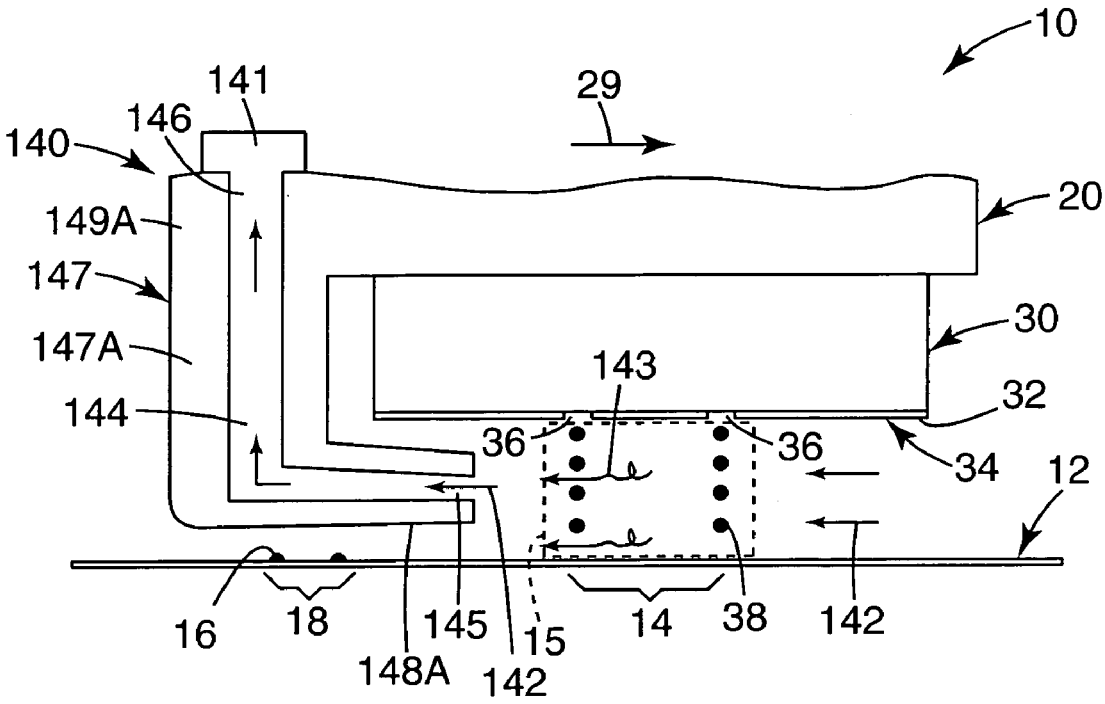
FIG. 3A is a side schematic view of another embodiment of the inkjet printer of FIG. 2A including another embodiment of an air current disruption system according to the present invention.
Figure 3B:
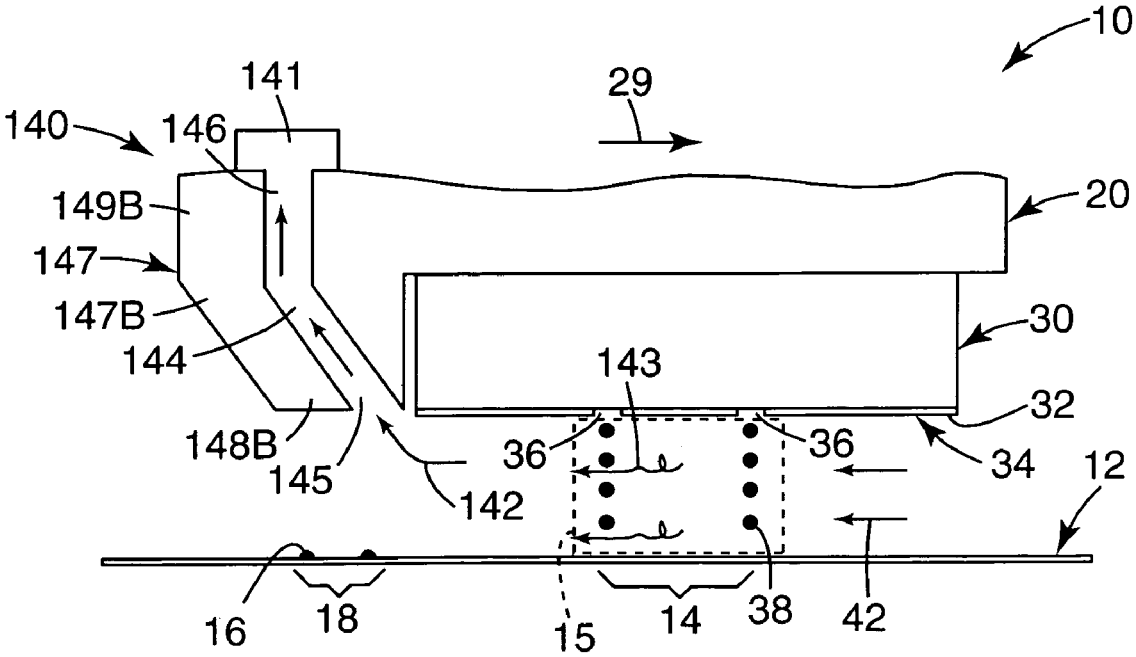
FIG. 3B is a side schematic view of the inkjet printer of FIG. 3A including an alternate embodiment of the air current disruption system according to the present invention.

FIGS. 3A and 3B illustrate another embodiment of inkjet printer 10 including printer carriage 20, print cartridge 30, and an air current disruption system 140 similar to air current disruption system 40. Air current disruption system 140 directs an air stream 142 through print zone 15 as ink drops 38 are ejected from printhead 34 during printing. As such, air current disruption system 140 disrupts air currents, as illustrated at 143, acting on ink drops 38 during printing to prevent print defects caused by the air currents. Air current disruption system 140, however, does not disrupt the intended ink drop trajectory of ink drops 38 during printing. In one embodiment, air stream 142 is directed substantially perpendicular to the intended ink drop trajectory and substantially parallel to print region 14 of print medium 12 toward which ink drops 38 are ejected.

In one embodiment, air stream 142 is directed in a direction toward already-imprinted region 18 of print medium 12. As illustrated in FIGS. 3A and 3B, for example, printer carriage 20 and print cartridge 30 move in the printing direction indicated by arrow 29, from left to right, relative to print medium 12. Thus, already-imprinted region 18 is created to the left of printer carriage 20. Air stream 142, therefore, is directed in a direction from right to left, toward already-imprinted region 18 or, conversely, opposite the printing direction indicated by arrow 29. It is, however, within the scope of the present invention for air stream 142 to be directed in a direction away from already-imprinted region 18 of print medium 12. When printer carriage 20 and print cartridge 30, for example, move in a direction opposite the printing direction indicated by arrow 29 in FIG. 3A, from right to left, relative to print medium 12, already-imprinted region 18 is created to the right of printer carriage 20. Air stream 142, therefore, is directed in a direction from right to left, away from already-imprinted region 18 or, conversely, with the printing direction.

In one embodiment, air current disruption system 140 includes an airflow channel 144 which directs air stream 142 through print zone 15. Airflow channel 144 includes an inlet flow path 145 and an outlet flow path 146. While inlet flow path 45 of air current disruption system 40 communicates with airflow source 41 to generate air stream 42 (FIGS. 2A, 2B, 2C, and 2D), outlet flow path 146 of air current disruption system 140 communicates with an airflow source 141 which generates air stream 142 and draws air stream 142 through airflow channel 144 (FIGS. 3A and 3B). In one embodiment, airflow source 141 includes a direct source which communicates with outlet flow path 146 and pulls air through inlet flow path 145 to create a vacuum next to printhead 34 which, in turn, draws air stream 142 through print zone 15 and into inlet flow path 145. An example of airflow source 141 is an extraction fan positioned within inkjet printer 10.

In one embodiment, as illustrated in FIGS. 3A and 3B, airflow channel 144 is formed by an airflow duct 147 provided at a side of printer carriage 20 for travel with printer carriage 20 during printing. While airflow duct 147 is illustrated as being formed integrally with printer carriage 20, it is within the scope of the present invention for airflow duct 147 to be formed separately from printer carriage 20. As such, it is also within the scope of the present invention for airflow duct 147 to move with printer carriage 20 or be held stationary relative to printer carriage 20.

FIG. 3A illustrates one embodiment of airflow duct 147. Airflow duct 147A includes an inlet portion 148A forming inlet flow path 145 of airflow channel 144 and an outlet portion 149A forming outlet flow path 146 of airflow channel 144. Inlet portion 148A is oriented substantially parallel to print region 14 of print medium 12 and substantially parallel to front face 32 of printhead 34. During printing, inlet portion 148A is interposed between print cartridge 30 and print medium 12 such that air stream 142 is directed through print zone 15 substantially parallel to print region 14 and front face 32 of printhead 34 and into inlet flow path 145 of air flow channel 144.

FIG. 3B illustrates another embodiment of airflow duct 147. Airflow duct 147B includes an inlet portion 148B forming inlet flow path 145 of airflow channel 144 and an outlet portion 149B forming outlet flow path 146 of airflow channel 144. Inlet portion 148B is oriented at an angle to print region 14 of print medium 12 and to front face 32 of printhead 34. Inlet portion 148B, however, does not project beyond front face 32 of printhead 34 so as to permit narrow pen-to-paper spacing. During printing, air stream 142 is directed through print zone 15 substantially parallel to print region 14 and front face 32 of printhead 34 and drawn into inlet flow path 145 of air flow channel 144.

Figure 4A:
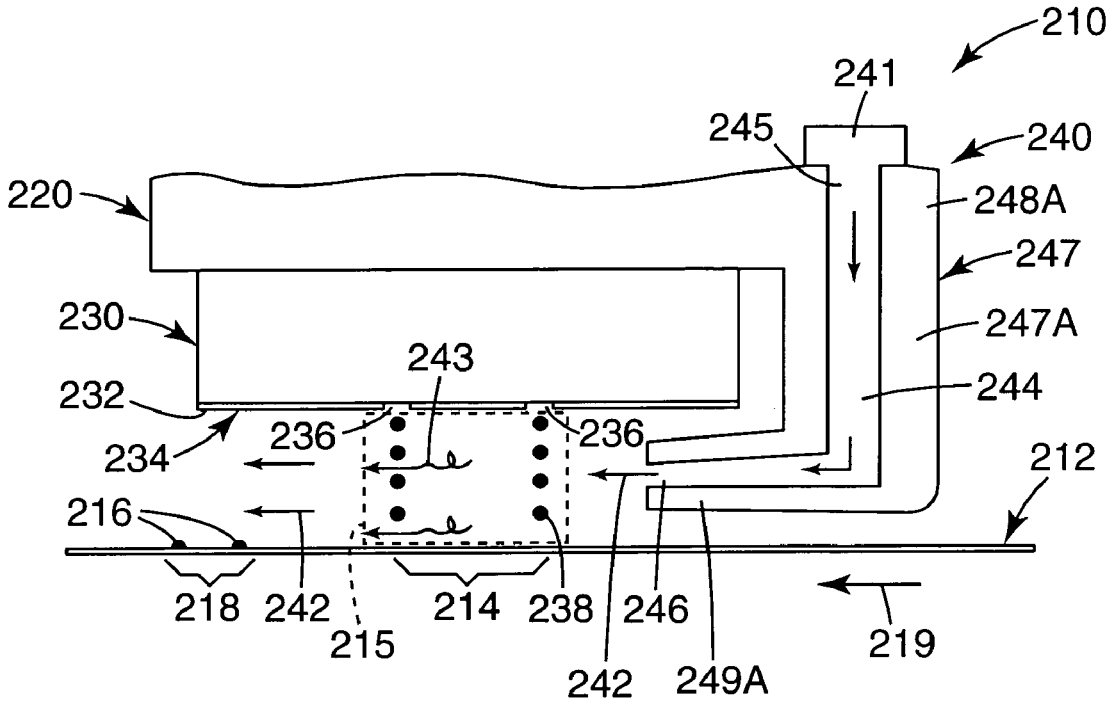
FIG. 4A is a side schematic view of another embodiment of a portion of an inkjet printer including one embodiment of an air current disruption system according to the present invention.
Figure 4B:
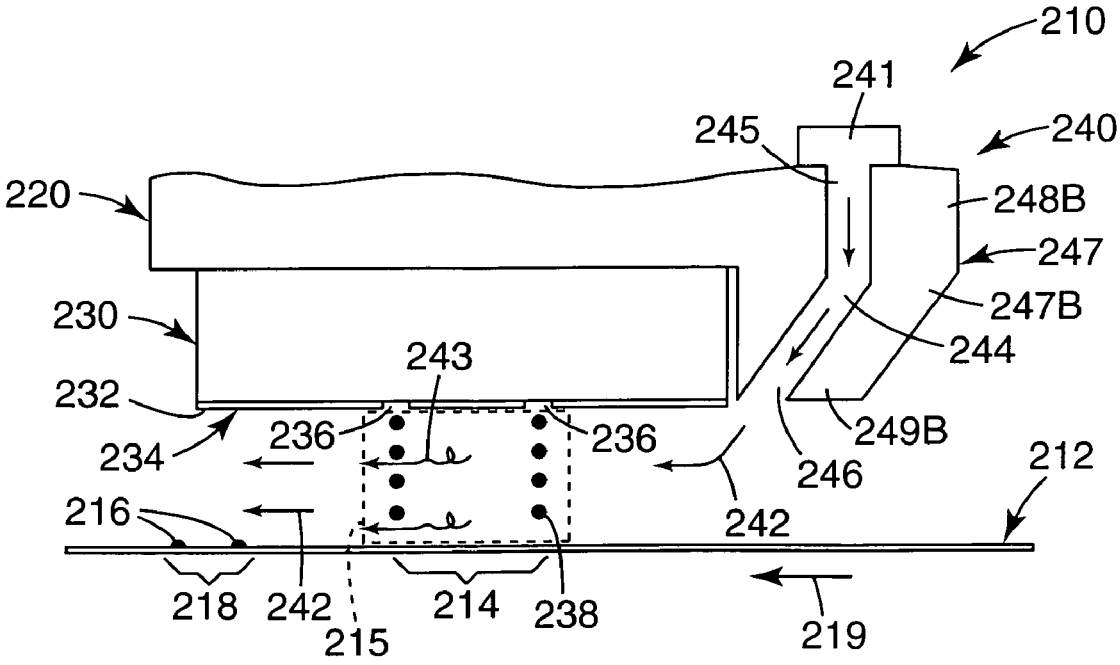
FIG. 4B is a side schematic view of the inkjet printer of FIG. 4A including an alternate embodiment of the air current disruption system according to the present invention.

FIGS. 4A and 4B illustrate another embodiment of a portion of an inkjet printer 210 for printing on a print medium 212. Inkjet printer 210 includes a printer carriage 220, a print cartridge 230, and an air current disruption system 240. Print medium 212 includes a print region 214 within which print 216 in the form of characters and graphics is created as relative movement between print cartridge 230 and print medium 212 occurs during printing. Inkjet printer 210 is similar to inkjet printer 10 with exception that, during printing, print medium 212 traverses in a direction indicated by arrow 219, which is opposite to a printing direction, for relative movement between print cartridge 230 and print medium 212. During printing, print medium 212 traverses in the direction of arrow 219 and printer carriage 220 advances in a direction substantially perpendicular to the direction indicated by arrow 219 (i.e., in and out of the plane of the paper). It is also within the scope of the present invention for print medium 212 to traverse in a direction opposite the direction indicated by arrow 219.

Printer carriage 220 is supported within a chassis (not shown) of inkjet printer 210 and print cartridge 230 is installed in printer carriage 220. Print cartridge 230 includes a printhead 234 having a front face 232 in which a plurality of ink orifices or nozzles 236 are formed. Operation of printhead 234 is the same as that previously described in connection with printhead 34 and, therefore, is omitted here.

During printing, ink drops 238 are ejected from printhead 234 toward print region 214 of print medium 212 to create print 216. As print medium 212 moves in the direction indicated by arrow 219, print 216 creates an already-imprinted region 218 of print medium 212. Ink drops 238 are ejected through ink orifices 236 and from printhead 234 into a print zone 215 with an intended ink drop trajectory. Print zone 215 is defined between printhead 234 and print medium 212, and encompasses ink drops 238.

Air current disruption system 240 for inkjet printer 210 is similar to air current disruption system 40 for inkjet printer 10. Air current disruption system 240 directs an air stream 242 through print zone 215 as ink drops 238 are ejected from printhead 234 during printing. As such, air current disruption system 240 disrupts air currents, as illustrated at 243, acting on ink drops 238 during printing to prevent print defects caused by the air currents. Air current disruption system 240, however, does not disrupt the intended ink drop trajectory of ink drops 238 during printing. In one embodiment, air stream 242 is directed substantially perpendicular to the intended ink drop trajectory and substantially parallel to print region 214 of print medium 212 toward which ink drops 238 are ejected.

In one embodiment, air stream 242 is directed in a direction toward already-imprinted region 218 of print medium 212. As illustrated in FIGS. 4A and 4B, for example, print medium 212 moves in the direction indicated by arrow 219, from right to left, relative to print cartridge 230. Thus, already-imprinted region 218 is created to the left of printer carriage 220. Air stream 242, therefore, is directed in a direction from right to left, toward already-imprinted region 218 or, conversely, opposite the printing direction. It is, however, within the scope of the present invention for air stream 242 to be directed in a direction away from already-imprinted region 218 of print medium 212. When print medium 212, for example, moves in a direction opposite the direction indicated by arrow 219 in FIG. 4A, from left to right, relative to printer carriage 220 and print cartridge 230, already-imprinted region 218 is created to the right of printer carriage 220. Air stream 242, therefore, is directed in a direction from right to left, away from already-imprinted region 218 or, conversely, with the printing direction.

In one embodiment, air current disruption system 240 includes an airflow channel 244 which directs air stream 242 through print zone 215. Airflow channel 244 includes an inlet flow path 245 and an outlet flow path 246. Inlet flow path 245 communicates with an airflow source 241 which creates a pressurized source of air which, in turn, generates and forces air stream 242 through airflow channel 244. In one embodiment, airflow source 241 includes a direct source which communicates with inlet flow path 245 and forces air stream 242 through airflow channel 244. An example of airflow source 241 is a fan positioned within inkjet printer 210.

In one embodiment, as illustrated in FIGS. 4A and 4B, airflow channel 244 is formed by an airflow duct 247. Airflow duct 247 is provided at a side of printer carriage 220 preceding print formation. FIG. 4A illustrates one embodiment of airflow duct 247 and FIG. 4B illustrates another embodiment of airflow duct 247. Airflow duct 247A is similar to airflow duct 47A and airflow duct 247B is similar to airflow duct 47B. As such, airflow duct 247A includes an inlet portion 248A forming inlet flow path 245 of airflow channel 244 and an outlet portion 249A forming outlet flow path 246 of airflow channel 244 and, airflow duct 247B includes an inlet portion 248B forming inlet flow path 245 of airflow channel 244 and an outlet portion 249B forming outlet flow path 246 of airflow channel 244.

Figure 5:
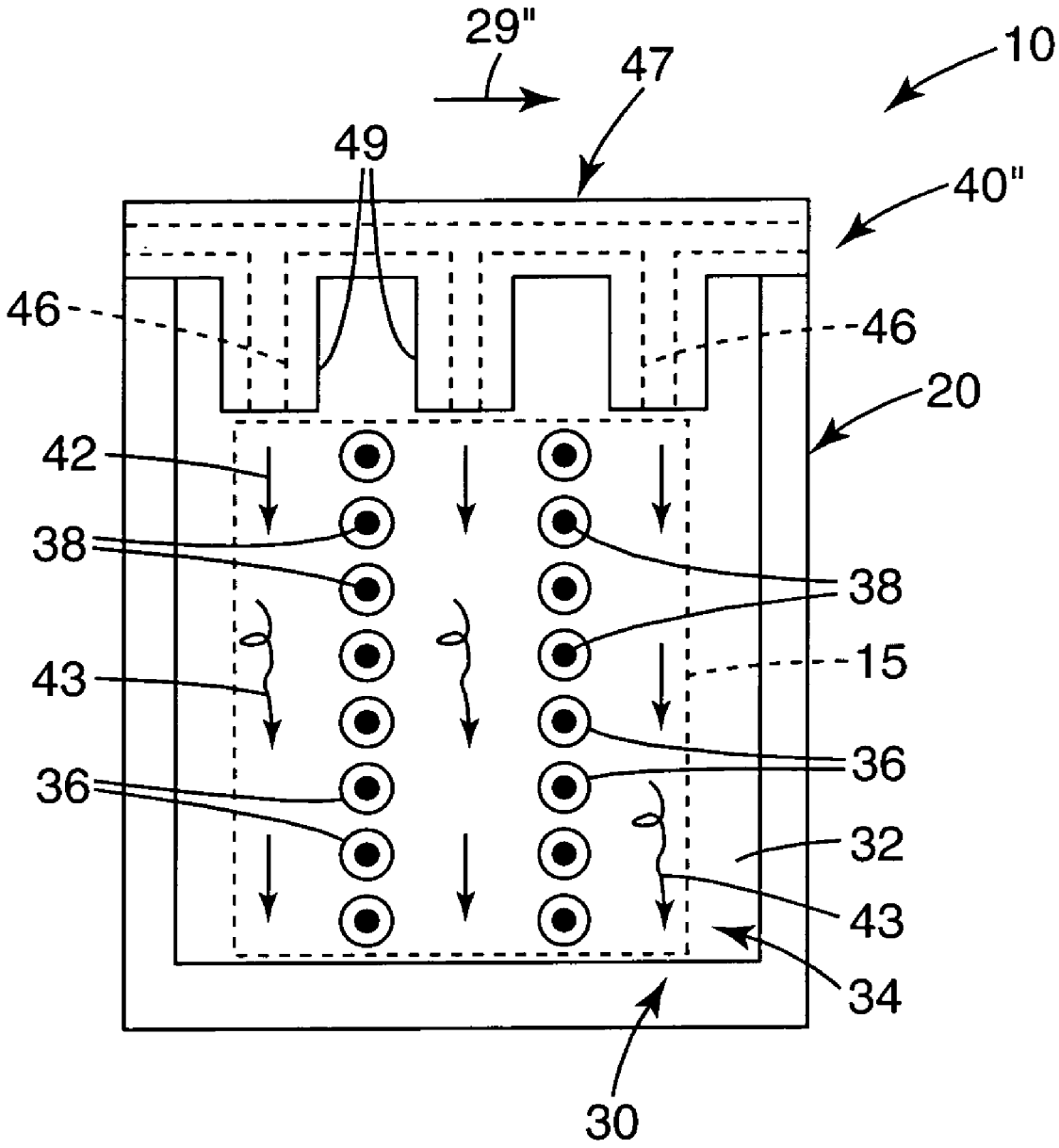
FIG. 5 is a bottom schematic view of another embodiment of the inkjet printer of FIG. 2A including another embodiment of an air current disruption system according to the present invention.

FIG. 5 illustrates another embodiment of inkjet printer 10 including printer carriage 20, print cartridge 30, and an air current disruption system 40". During printing, printer carriage 20 moves in the printing direction indicated by arrow 29" and air current disruption system 40" directs air stream 42 through print zone 15 as ink drops 38 are ejected from printhead 34. As such, air current disruption system 40" disrupts air currents, as illustrated at 43, acting on ink drops 38 during printing. Air current disruption system 40", however, does not disrupt the intended ink drop trajectory of ink drops 38 during printing.

In one embodiment, as illustrated in FIG. 5, air stream 42 is directed substantially parallel to the intended ink drop trajectory and substantially parallel to front face 32 of printhead 34. As described above, the intended ink drop trajectory is defined by a plurality of ink drops 38 ejected toward print medium 12 to form a curtain of ink drops 38 extending between printhead 34 and print medium 12. Thus, with air stream 42 being directed substantially parallel to the intended ink drop trajectory, air stream 42 is directed substantially parallel to a curtain of ink drops 38 extending between printhead 34 and print medium 12. In addition, as the curtain of ink drops 38 is formed by a column of ink orifices 36, air stream 42 is directed substantially parallel to a column of ink orifices 36.

In use, air current disruption system 40,40',40", for example, directs air stream 42 through print zone 15 as ink drops 38 are ejected from printhead 34 during printing. Air stream 42 is directed substantially parallel to print region 14 of print medium 12 and front face 32 of printhead 34. In one embodiment, air stream 42 is directed in a direction toward already-imprinted region 18 of print medium 12 or, conversely, in a direction opposite the printing direction indicated by arrow 29,29'. In an alternate embodiment, air stream 42 is directed in a direction away from already-imprinted region 18 of print medium 12. In one embodiment, air stream 42,42' is directed in a direction substantially parallel to the printing direction indicated by arrow 29,29' (i.e., with the plane of the paper) and substantially perpendicular to the intended ink drop trajectory. In an alternate embodiment, air stream 42 is directed in a direction substantially perpendicular to the printing direction indicated by arrow 29" and substantially parallel to the intended ink drop trajectory. While air stream 42 is illustrated as being directed substantially perpendicular and substantially parallel to the intended ink drop trajectory, it is also within the scope of the present invention for air stream 42 to be directed at any angle between substantially perpendicular and substantially parallel. Thus, it is within the scope of the present invention for air stream 42 to be directed at an angle to the intended ink drop trajectory and an axis of motion of printer carriage 20.

A speed of air stream 42 is selected so as to disrupt air currents acting on ink drops 38 during printing, but not disrupt the intended ink drop trajectory during printing. In one illustrative embodiment, the speed of air stream 42 through print zone 15 is in a range of approximately 0.5 meters/second to approximately 2.0 meters/second. In another illustrative embodiment, the speed of air stream 42 is limited to a range of approximately 1.0 meters/second to approximately 1.5 meters/second. In another illustrative embodiment, the speed of air stream 42 is approximately 1.0 meters/second. In addition, a relative speed between printer carriage 20 and print medium 12 is approximately 0.5 meters/second or higher, and a pen-to-paper spacing between print cartridge 30 and print medium 12 is approximately 1 millimeter or more. In addition, a firing frequency of print cartridge 30 is approximately 12 kilohertz or higher, and a spacing of ink orifices 36 of printhead 34 is approximately 84 micrometers or less. Furthermore, a drop volume of each of ink drops 38 is approximately 10 picoliters or less, and a drop velocity of each of ink drops 38 is approximately 5 meters/second or greater.

Figure 6:
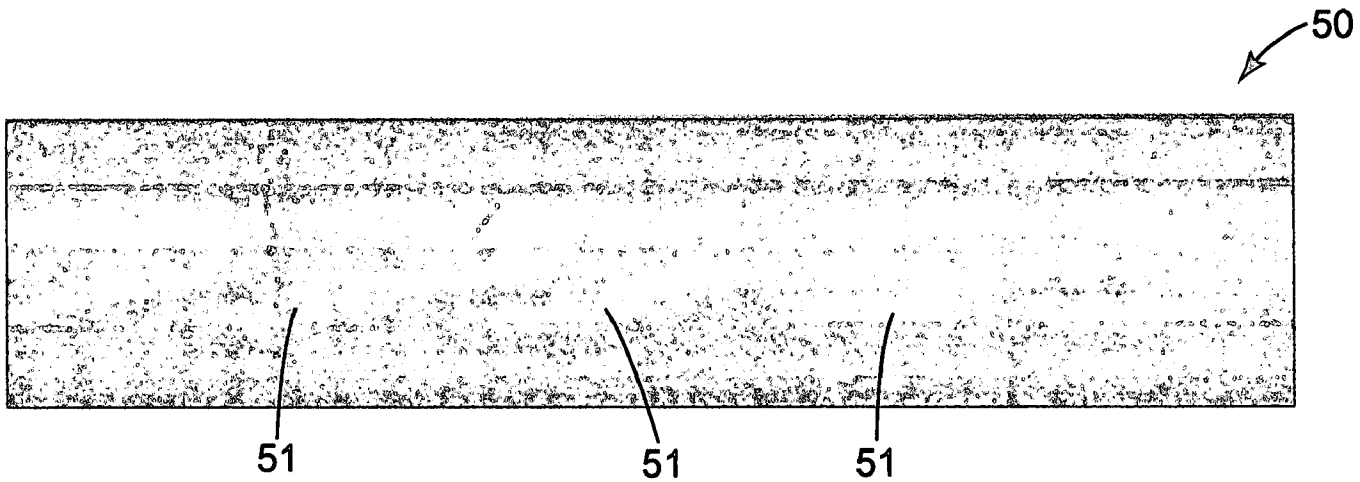
Fig. 6 PRIOR ART
FIG. 6 is an enlarged portion of an image printed by a prior art inkjet printer.
Figure 7:
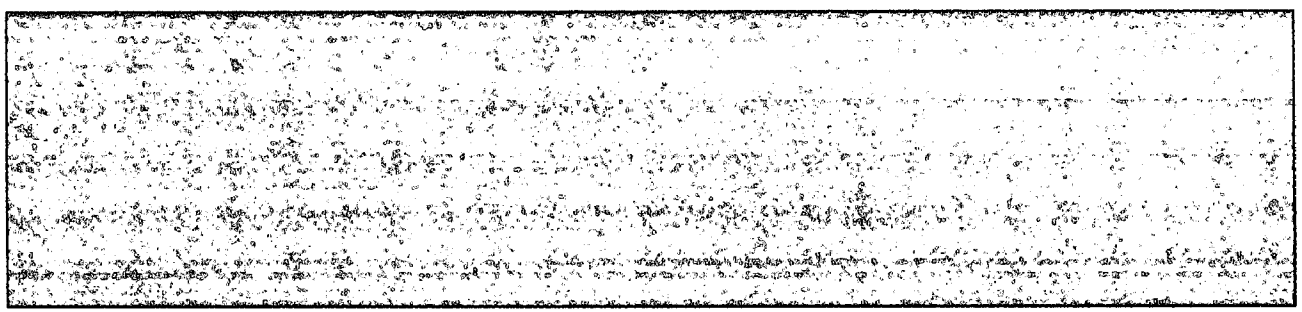
FIG. 7 is an enlarged portion of an image printed by an inkjet printer including an air current disruption system according to the present invention.

FIGS. 6 and 7 illustrate enlarged image portions printed by an inkjet printer without and with, respectively, an air current disruption system according to the present invention. FIG. 6 illustrates an enlarged image portion 50 printed without an air current disruption system according to the present invention. As illustrated in FIG. 6, enlarged image portion 50 includes print defects 51 which are identifiable by dark lines or patches in areas of uniform gray. Print defects 51, commonly referred to as "worms," produce a patterned or mottled appearance and, as such, degrade image quality. FIG. 7 illustrates an enlarged image portion 52 printed with an air current disruption system according to the present invention. As illustrated in FIG. 7, enlarged image portion 52 does not include print defects 51 identifiable in FIG. 6. Thus, image quality is enhanced with the air current disruption system according to the present invention.

By directing air stream 42 through the print zone 15 as ink drops 38 are ejected during printing, air current disruption system 40 disrupts air currents acting on ink drops 38 during printing, but does not disrupt the intended trajectory of ink drops 38 during printing. As such, undesirable print defects 51, such as "worms," are avoided without compromising image resolution, printing speed, and/or accommodation of various thickness of print medium.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printer for printing on a print medium, the inkjet printer comprising:

a printhead having a front face with a plurality of columns of ink orifices formed therein through which ink drops are ejected into a print zone between the printhead and the print medium during printing, wherein a number of ink orifices within each column of ink orifices is greater than a number of the columns of ink orifices, and wherein the printhead is adapted to traverse the print medium in a direction substantially perpendicular to the columns of ink orifices during printing; and an air current disruption system including a flow duct having an outlet portion extended into a space between a portion of the front face of the printhead having the columns of ink orifices formed therein and the print medium, the air current disruption system directing a stream of gas through the flow duct and through the print zone across the front face of the printhead substantially perpendicular to the columns of ink orifices in one of a printing direction and a direction opposite the printing direction as the ink drops are ejected during printing, wherein a speed of the stream of gas through the print zone is approximately 2.0 meters/second or less, and wherein the stream of gas disrupts air currents acting on the ink drops during printing to prevent print defects caused by the air currents.

2. The inkjet printer of claim 1, wherein the ink drops are ejected into the print zone between the printhead and the print medium with an intended ink drop trajectory toward the print medium during printing, and wherein the stream of gas disrupts the air currents acting on the ink drops during printing, but does not disrupt the intended ink drop trajectory during printing.

3. The inkjet printer of claim 1, wherein the ink drops are ejected into the print zone between the printhead and the print medium with an intended ink drop trajectory toward the print medium during printing, and wherein the air current disruption system directs the stream of gas through the intended ink drop trajectory.

4. The inkjet printer of claim 1, wherein the ink drops are ejected into the print zone between the printhead and the print medium with an intended ink drop trajectory toward the print medium during printing, wherein the intended ink drop trajectory is substantially perpendicular to a print region of the print medium toward which the ink drops are ejected, and wherein the air current disruption system directs the stream of gas substantially parallel to the print region.

5. The inkjet printer of claim 1, wherein the air current disruption system directs the stream of gas substantially parallel to the front face of the printhead.

6. The inkjet printer of claim 1, wherein the flow duct forms an outlet flow path oriented substantially parallel to a print region of the print medium toward which the ink drops are ejected.

7. The inkjet printer of claim 1, wherein the stream of gas is an air stream.

8. The inkjet printer of claim 7, wherein the air current disruption system includes an airflow source which creates pressurized air within the printer to generate the air stream.

9. The inkjet printer of claim 7, wherein the air current disruption system includes an airflow source which creates a vacuum within the printer to generate the air stream.

10. The inkjet printer of claim 7, wherein the printhead is installed in a printer carriage, and wherein movement of the printer carriage within the printer generates the air stream.

11. The inkjet printer of claim 1, wherein the air currents acting on the ink drops during printing form air vortices, and wherein the stream of gas disrupts the air vortices.

12. The inkjet printer of claim 1, wherein a speed of the stream of gas through the print zone is in a range of approximately 0.5 meters/second to approximately 2.0 meters/second.

13. The inkjet printer of claim 12, wherein the speed of the stream of gas is in a range of approximately 1.0 meters/second to approximately 1.5 meters/second.

14. A method of printing on a print medium with an inkjet printer including a printhead having a front face with a plurality of columns of ink orifices formed therein, a number of ink orifices within each column of ink orifices being greater than a number of the columns of ink orifices, the method comprising:

traversing the print medium with the printhead in a direction substantially perpendicular to the columns of ink orifices during printing;

ejecting ink drops through the ink orifices into a print zone between the printhead and the print medium during printing; and directing a stream of gas through the print zone across the front face of the printhead substantially perpendicular to the columns of ink orifices with a flow duct having an outlet portion extended into a space between a portion of the front face of the printhead having the columns of ink orifices formed therein and the print medium, including directing the stream of gas in one of a printing direction and a direction opposite the printing direction while ejecting the ink drops through the ink orifices during printing, and directing the stream of gas through the print zone with a speed of approximately 2.0 meters/second or less, wherein the stream of gas disrupts air currents acting on the ink drops during printing to prevent print defects caused by the air currents.

15. The method of claim 14, wherein ejecting ink drops through the ink orifices into the print zone between the printhead and the print medium includes ejecting the ink drops with an intended ink drop trajectory toward the print medium during printing, and wherein directing the stream of gas through the print zone includes disrupting the air currents acting on the ink drops during printing, but not disrupting the intended ink drop trajectory during printing.

16. The method of claim 14, wherein ejecting ink drops through the ink orifices into the print zone between the printhead and the print medium includes ejecting the ink drops with an intended ink drop trajectory toward the print medium during printing, and wherein directing the stream of gas through the print zone includes directing the stream of gas through the intended ink drop trajectory.

17. The method of claim 14, wherein ejecting ink drops through the ink orifices into the print zone between the printhead and the print medium includes ejecting the ink drops with an intended ink drop trajectory toward the print medium during printing, wherein the intended ink drop trajectory is substantially perpendicular to a print region of the print medium toward which the ink drops are ejected, and wherein directing the stream of gas through the print zone includes directing the stream of gas in a direction substantially parallel to the print region.

18. The method of claim 14, wherein directing the stream of gas through the print zone includes directing the stream of gas in a direction substantially parallel to the front face of the printhead.

19. The method of claim 14, wherein the flow duct forms an outlet flow path oriented substantially parallel to a print region of the print medium toward which the ink drops are ejected.

20. The method of claim 14, wherein directing the stream of gas through the print zone includes directing an air stream through the print zone.

21. The method of claim 20, wherein directing the air stream through the print zone includes generating the air stream with pressurized air.

22. The method of claim 20, wherein directing the air stream through the print zone includes creating a vacuum within the printer to generate the air stream.

23. The method of claim 20, wherein the printhead is installed in a printer carriage, and wherein directing the air stream through the print zone includes generating the air stream by movement of the printer carriage within the printer.

24. The method of claim 14, wherein the air currents acting on the ink drops during printing form air vortices, and wherein directing the stream of gas through the print zone includes disrupting the air vortices.

25. The method of claim 14, wherein directing the stream of gas through the print zone includes directing the stream of gas through the print zone with a speed in a range of approximately 0.5 meters/second to approximately 2.0 meters/second.

26. The method of claim 25, wherein the speed of the stream of gas is in a range of approximately 1.0 meters/second to approximately 1.5 meters/second.

* * * * *